United States Patent [19]

Watkins

[11] 4,101,022

[45] Jul. 18, 1978

[54] RECESSED END CONTAINER

[75] Inventor: Caesar E. Watkins, Carrollton, Tex.

[73] Assignee: Inland Container Corporation, Indianapolis, Ind.

[21] Appl. No.: 781,643

[22] Filed: Mar. 28, 1977

[51] Int. Cl.[2] ..... B65D 5/10; B65D 5/50

[52] U.S. Cl. ..... 206/45.14; 206/521; 229/39 R

[58] Field of Search ..... 229/39 R, 34 HW; 206/45.14, 521

[56] References Cited

U.S. PATENT DOCUMENTS

| | | | |
|---|---|---|---|
| 2,306,328 | 12/1942 | Biberthaler | 229/39 R |
| 2,779,527 | 1/1957 | Fallert | 229/39 R |
| 3,061,168 | 10/1962 | Galloway | 229/39 R |
| 3,578,154 | 5/1971 | Martelli | 206/45.14 |
| 3,866,745 | 2/1975 | Dlugopolski | 206/34 HW |

*Primary Examiner*—William Price
*Assistant Examiner*—Allan N. Shoap
*Attorney, Agent, or Firm*—Fitch, Even, Tabin & Luedeka

[57] ABSTRACT

A recessed end container is disclosed which has self-locking end flaps foldable a preselected distance into the container and closing the container at the interior location. Certain of the flaps include opening means which interlock with tabs on other of the flaps to secure the flaps together in the folded recessed position.

2 Claims, 6 Drawing Figures

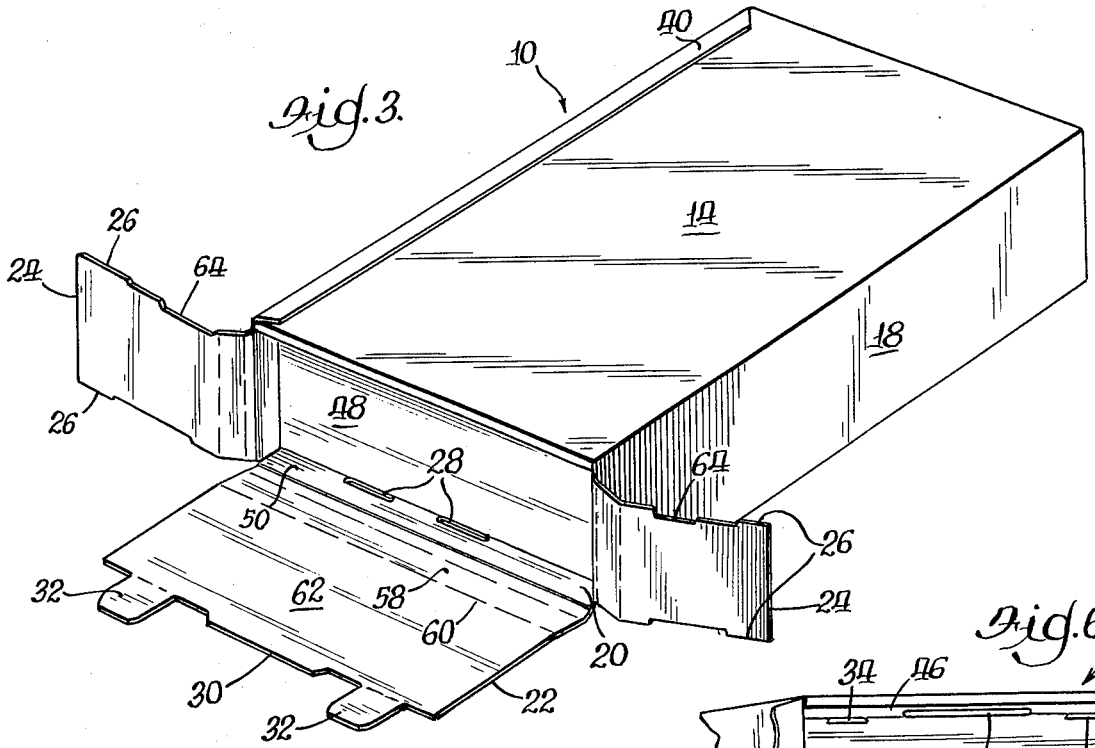
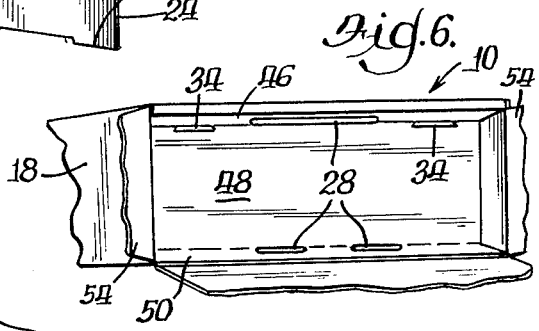
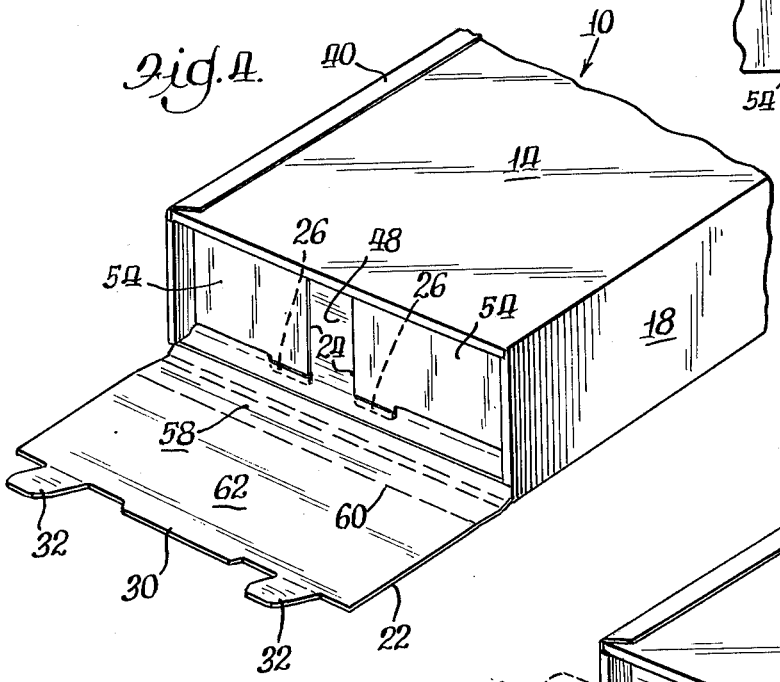
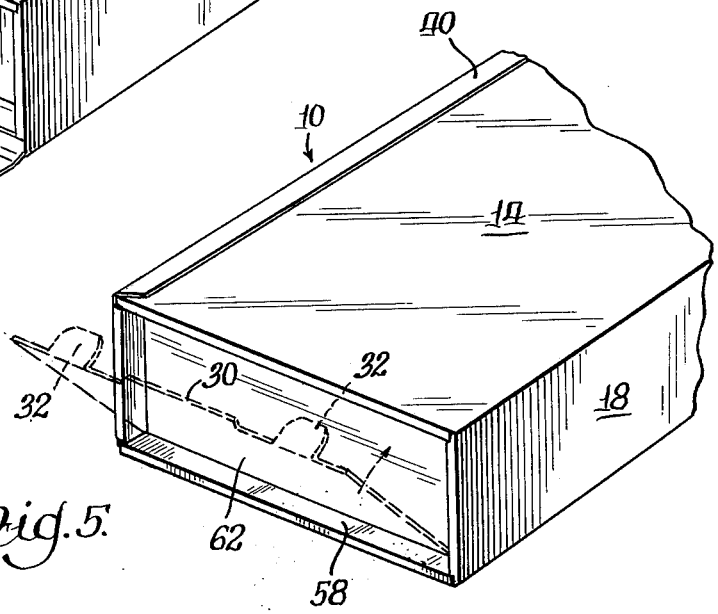
Fig. 5.

RECESSED END CONTAINER

The present invention generally relates to fiberboard containers for shipping articles. More particularly, this invention relates to containers which have recessed ends to protect the contents against damage from shock or vibration.

Fiberboard containers utilizing recessed ends to protect the contents from damage are well known in the packaging industry. For example, bookwraps, which are old in the art, overlap the ends of the enclosed book to protect it against damage if dropped. U.S. Pat. No. 3,866,745 to Dlugopolski is probably more pertinent to the present invention. That patent shows a container with a recessed end closure in which one of the end flaps may be folded to conform to the shape of the enclosed article, a sink, and overlies the flange of the sink to act as a hold-down.

It is an object of the present invention to provide an improved recessed end container that is of one-piece construction and easy to set up without the use of tape, glue or stitching and without complicated folding of the end flaps.

Another object of the present invention is to provide a self-locking recessed end container that is suitable for shipping and protecting heavy or bulky industrial items, such as sinks or the like.

These and other objects of the present invention are set forth in the following detailed description and the accompanying drawings, of which, FIG. 1 is a plan view, partially broken away, of a one-piece fiberboard blank embodying various features of the present invention.

FIGS. 3–5 are perspective views of the container of FIG. 2 showing the successive folding of the end flaps to provide a recessed end closure.

FIG. 6 is a perspective view of the end of the container of FIG. 3, taken from a different angle.

Figure 1:
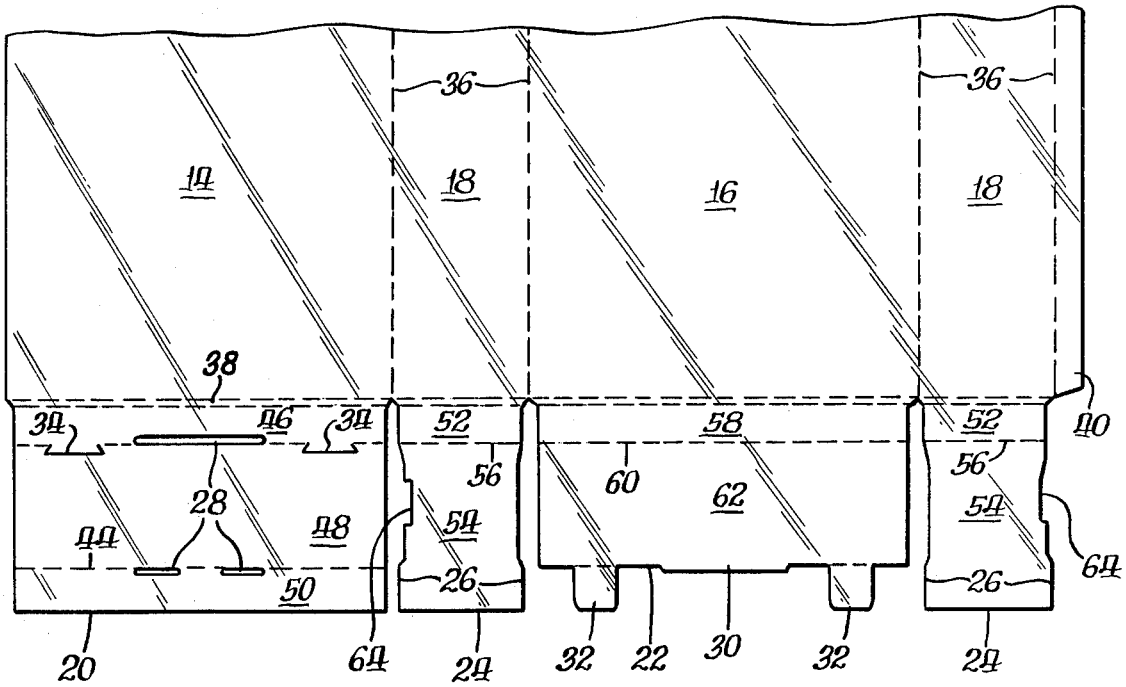

The present invention is generally embodied in a recessed end fiberboard container 10 which is erected from a one-piece fiberboard blank 12. Score lines or similiar lines of weakness divide the blank into top, bottom and side walls 14, 16 and 18, and top, bottom and side flaps 20, 22 and 24 which are hinged to the ends of their respective walls. The blank may be formed into a generally tubular compartment by joining the side edges. In accordance with the present invention, a recessed closure is provided at the end of the tubular compartment by folding the flaps a preselected distance into the compartment at which position the flaps are again folded, to point in the direction of the opposite wall. Each of the top and the bottom flaps is of sufficient length and width to substantially close the compartment at the interior position, and each side end flap may be of sufficient length to extend up to approximately halfway toward the opposing side wall. The side flaps are preferrably sandwiched between the top and bottom flaps at the interior position, and they also have lock tabs 26 which may be inserted into slotted openings 28 in the innermost of the top and bottom flaps. The outermost flap, which is the bottom flap 22 in the illustrated embodiment, also has a lock tab 30 on its free edge which may be inserted into one of the slotted openings 28 to hold the flaps in the folded position. A pair of fold tabs 32 are further provided on the bottom flap and folded to extend into the tubular compartment, past the side flaps and into slitted openings 34 in the top flap therebehind. With this construction, a recessed end container may be simply and quickly erected by folding the top flap into the tubular compartment, the side flaps being folded thereafter, with the lock tabs 26 being inserted into the slots 28, and finally the bottom flap 22 being folded into the compartment, with the lock tab 30 and fold tabs 32 holding the end flaps in the folded and recessed configuration and protecting the contents against damage from shock or vibration to the end of the container.

Turning now to a more detailed description of the preferred embodiment of the present invention, which is shown in the attached drawings for purposes of illustration and not limitation, the container 10 is erected from the single blank of fiberboard 12. Only one end of the blank is illustrated in FIG. 1. The other end is preferrably a mirror image of the illustrated portion and the details of folding and erecting are the same. The blank 12 is preferrably made of typical corrugated fiberboard, with the corrugations running from end to end. The strength of the fiberboard may vary, depending on the size and weight of the contents, as well as the amount of protection desired. The selection of proper sizing and strength is not significant to a description of the present invention, and it may be easily determined by one skilled in the art.

Score lines, or other lines of weakness, such as cut lines, divide the blank 12 into container walls and flaps. The side edges of the top, bottom and side walls 14, 16 and 18 are defined by parallel score lines 36. The end edges of the walls are defined by a double score line 38, which is perpendicular to the score lines 36, and along which the flaps are attached to their respective walls—top flap 20 to top wall 14, bottom flap 22 to bottom wall 16 and side flaps 24 to side walls 18.

The blank 12 is formed into a flat-folded tubular compartment by folding along two score lines 36. To secure the blank in this configuration a manufacturer's joint is provided by a glue flap 40 which is attached along one edge of one side wall 18, and overlaps the edge of the top wall 14 to which it is attached as by gluing. The container may be shipped in this configuration, or it may be sold as a flat blank, leaving it to the ultimate user to complete the manufacturer's joint. Tape may also be used to join the edges of the blank in lieu of the glue flap 40.

After the manufacturer's joint is made, the container may be squared so that adjacent walls are at substantially right angles to each other, thus providing a rectangular parallelipiped tubular compartment. The article or contents (not shown) are then inserted into the compartment, and a protective recessed end is formed by folding the flaps into the compartment so that they close the container at a location spaced interiorly from the end edges of the top, bottom and side wall. The top flap 20 is preferrably the first flap folded into the compartment, and is thus the innermost flap when set-up is completed. Fold lines 42 and 44, which are parallel to the fold line 38, divide the top end flap 20 into three panels, a first or minor panel 46 between the fold line 38 and fold line 42, a second or major panel 48 between the fold line 42 and the fold line 44 and a third or minor panel 50 between the fold line 44 and the end edge of the top flap. For attaching the top flap to the other flaps the slotted openings 28 in the top flap include a centrally located elongated slot in the first panel 46 and a pair of spaced slots therebelow in panel 50.

Figure 2:
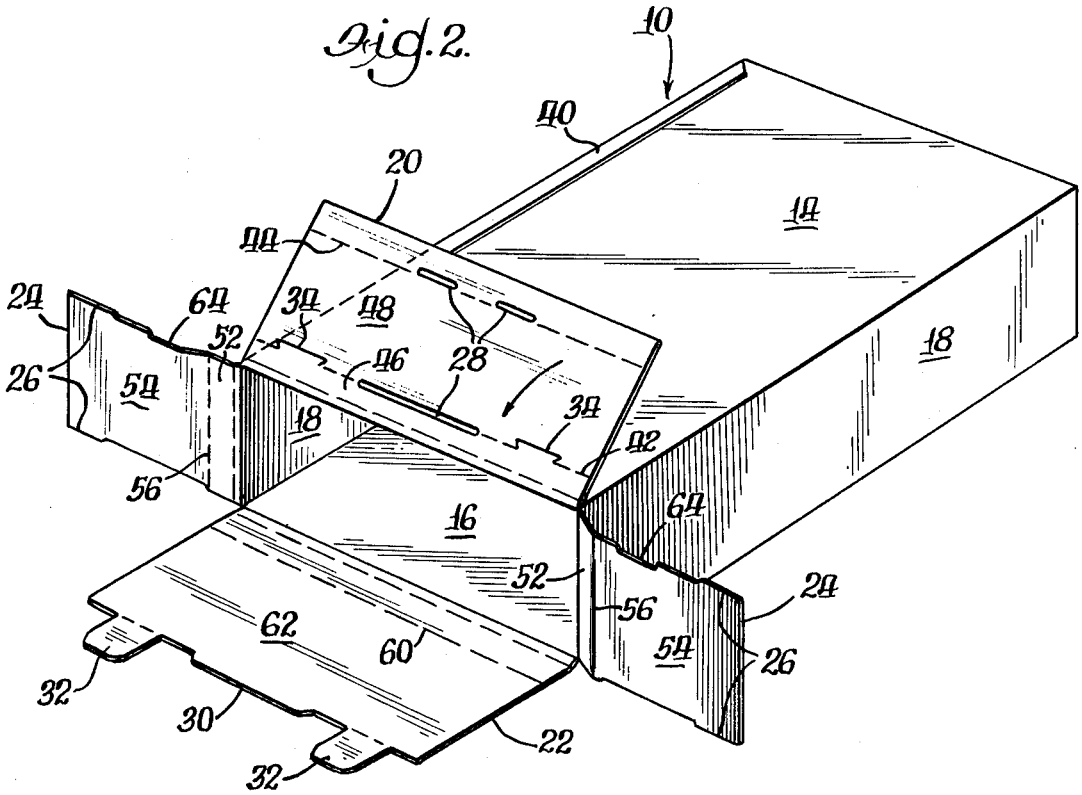
FIG. 2 is a perspective view of a partially erected container formed from the blank of FIG. 1.

As may be seen in FIGS. 2, 3 and 6, the top flap 20 is folded into the container along fold line 38 so that the first panel 46 extends directly into the container, generally underlying and parallel to the top wall 14. The double score permits easier folding of the end flaps through the 180° angle at the end of each wall. The length of the panel 46 determines the depth at which the flaps are recessed from the end edges of the container walls. This distance may vary, depending on the specific contents or articles contained, as well as the amount of protection desired. The major panel 48 of the top flap is folded at right angles to the minor panel 46 along the fold line 42 and extends substantially from the top wall 14 to the bottom wall 16 and between the side walls 18. The minor panel 50 is folded perpendicularly to the major panel along the fold line 44 so as to extend in a return direction, toward the end edge of the container walls, and overlying and being parallel to the end portion of the bottom wall 16, as seen in FIG. 3. The length of the minor panel 50 is substantially the same as the other minor panel 46, so that the end edge of the top flap terminates adjacent to the end edge of the bottom wall.

The side flaps 24 are folded after the top flap has been folded into the recessed position. Each side end flap has a first or minor panel 52 which is hinged along the double score line 38 to the end edge of the side wall 18 and a second or major panel 54 which is hinged along a fold line 56 to the minor panel 52. The major panel terminates with the pair of oppositely disposed lock tabs 26, one on each lateral edge. The side flaps are folded into the container with the minor panel 52 extending directly into the container generally adjacent and parallel to the wall to which it is attached. The length of each minor panel 52 is only slightly less than that of the minor panel 46 of the top end flap, so that each side flap extends to adjacent the top flap at the selected position inside the tubular compartment. The major panel 54 of the side flap is then folded along fold lines 56 at a right angle to the minor panel 52, so that the major panel extends directly toward the opposite side wall and is parallel to and closely adjacent the major panel 48 of the top flap. Except as hereinafter described otherwise, the width of the side flap is sufficient for it to substantially fill the distance between the minor panel 46 and minor panel 50 of the top flap 20.

As noted earlier, the major panel 54 of each side flap 24 terminates with a pair of oppositely disposed lock tabs 26. When the major panel 54 is folded into position, the lock tabs 26 are inserted into the slotted openings 28 in the minor panels of the top flap 20, which generally follow the fold lines 42 and 44, in the top flap. By inserting the tabs 26 into the slots 28, the side end flaps are locked in the vertical folded position, giving additional stacking strength to the container. The length of the side flaps may vary, depending on the particular contents. In most cases, however, they will not be long enough to extend more than halfway across the container opening.

After the side flaps are locked in position, the bottom flap is folded into the container. The bottom flap has a first or minor panel 58 between the fold line 38 and a parallel fold line 60, and a second or major panel 62 between the fold line 60 and the end edge or free end of the flap. On the end edge the bottom flap has a center lock tab 30 flanked by the earlier described pair of fold tabs 32, which are foldable along the end edge. The length of the minor panel 58 is preferrably only slightly less than the length of the first panels of the other flaps, so that the bottom flap will be recessed in the container adjacent to the other flaps. As shown in FIGS. 4 and 5, the bottom flap is folded upwardly into the container, with the minor panel 58 extending directly into the compartment, generally parallel to the bottom wall 16, and overlying the minor panel 50 of the top flap. The major panel 62 is then folded into an upright position, extending fully between and perpendicular to the minor panels, 46 and 50, of the top flap 20, with the center lock tab 30 inserted into the single elongated slot 28 in the upper panel of the top flap.

To help hold the major panel 62 of the bottom flap 22 in the upright position, the tabs 32 are also engaged to the other end flaps. As the major flap is folded upwardly, the tabs are folded along the end edges of the flap to point into the container. The upper edge of each side flap has a recess 64 to provide a passageway to the slitted openings 34, described earlier, in the major panel 48 of the top flap. The slits 34 are made by providing an elongated slit in the fiberboard, with a pair of short, generally transverse end cuts. This provides a resilient hinge through which the fold tab 33 may be inserted and which grips the fold tab to restrict withdrawal.

Thus, it can be seen that with the present invention, a recessed end container, with self-locking end flaps firmly secured in the recessed position is easy and simple to set-up from the flat-folded tubular blank without the need for glue, tape or stitching on the end flaps. The top flap is wedged into the end of the container, with a major panel of the flap extending fully between the top and bottom walls and the minor panels extending between the major panel and the end edges of the top and bottom walls. The side flaps are then folded into the recessed position and lock tabs on the end of each side flap are received in upper and lower slots in the minor panels of the top flap. The bottom flap is then finally folded into the recessed position, with the minor panel of the bottom flap overlapping the free edge of the top flap, assuring against accidental opening due to inside pressure by the contents. The major panel of the bottom end flap extends fully between the minor panels of the top flap and has a lock tab on the end which is inserted into one of the top flap slots and a pair of tabs which are inserted past the side flaps into slits therebehind. Thus, the end flaps are held securely together in the recessed position, the major panels of the side end flaps being sandwiched between the major panels of the top and bottom flaps, with each panel interlocked with the others.

Although the present invention has been described in terms of the preferred embodiment, it is not intended to disclaim various modifications which may be made by one skilled in the art, some of which may be immediately obvious and others which may occur only after some study. For example, in the present invention the top and bottom end flaps could be interchanged, with the bottom end flap having a center major panel between a pair of minor panels and with the top end flap having a single minor panel and a major panel terminating with a center lock tab flanked by a pair of fold tabs.

Other features of the present invention are set forth in the following claims.

What is claimed is:

1. A package which includes an article disposed within a recessed end container, said container including top, bottom and side walls joined to form a generally rectangular tubular compartment wherein said article is contained and closure means at each end of said compartment, said closure means at one end of said compartment including top, bottom and side flaps hinged respectively to said top, bottom and side walls, wherein the improvement comprises one of said top and bottom flaps having a first minor panel which extends into said compartment and which is hinged to a major panel that extends between said top and bottom walls at a location spaced interiorly of the end edge of said compartment, said major panel being hinged in turn to a second minor panel that extends to said end edge, said one flap also having slotted opening means in each of said minor panels adjacent the hinge lines with said major panel and slit means in said major panel, said side flaps each having a minor panel which is folded into said compartment, a major panel lying adjacent said one flap at said interior location and extending toward the opposite side wall and lock tabs on the upper and lower edges of said side flaps which are received in said slotted openings in said one flap to hold said side flaps in the folded position, the other of said top and bottom flaps having a minor panel which is folded into said compartment over said second minor panel and a major panel which lies adjacent said side flap major panels and extends between said top and bottom walls, thereby sandwiching said side flaps between said one flap and said other flap, said other flap major panel having fold tab means and having a lock tab formed at its end edge, said lock tab being received in said slotted opening means in said first minor panel of said one flap and said fold tab means extending past said side flaps and being received in said slit means in said major panel of said one flap to thereby hold said four flaps in closed position.

2. A package in accordance with claim 1 wherein said fold tab means are hinged to said end edge of said other flap in flanking relationship to said lock tab.

* * * * *